United States Patent [19]

Gildea

[11] 3,969,776

[45] July 20, 1976

[54] WATER LOUNGE

[76] Inventor: Robert Gildea, 2213 Ogletown Road, Newark, Del. 19711

[22] Filed: July 31, 1975

[21] Appl. No.: 600,631

[52] U.S. Cl. ..... 4/172; 4/172.11; 4/185 HB

[51] Int. Cl.[2] ..... E04H 3/16; E04H 3/18; F16L 21/02

[58] Field of Search ..... 4/172, 172.19, 172.11, 4/173, 177, 177 IW–185, 185 HB

[56] References Cited

UNITED STATES PATENTS

| | | | |
|---|---|---|---|
| 2,566,495 | 9/1951 | Miyakawa | 4/173 |
| 2,724,123 | 11/1955 | Kesler | 4/172 |
| 2,886,828 | 5/1959 | Lattuca | 4/172 |
| 3,421,162 | 1/1969 | Diemond et al. | 4/172 |
| 3,496,577 | 2/1970 | Saldana | 4/173 |
| 3,496,579 | 2/1970 | Petersen | 4/173 |
| 3,648,300 | 3/1972 | Eisenberg | 4/172.19 |
| 3,823,426 | 7/1974 | Mitchko | 4/172 |

*Primary Examiner*—Henry K. Artis

[57] ABSTRACT

Water lounge comprises generally rectangular shaped impervious body portion including bottom wall with front, back and side walls extending upwardly therefrom adapted to hold water. Spaced apart wheels are rotatably secured to body portion near back wall thereof, and adjustable backrest is within body portion also near back wall thereof. Drain is provided in bottom wall of body portion, and several props extend downwardly from body portion near front wall thereof for maintaining body portion generally level.

10 Claims, 6 Drawing Figures

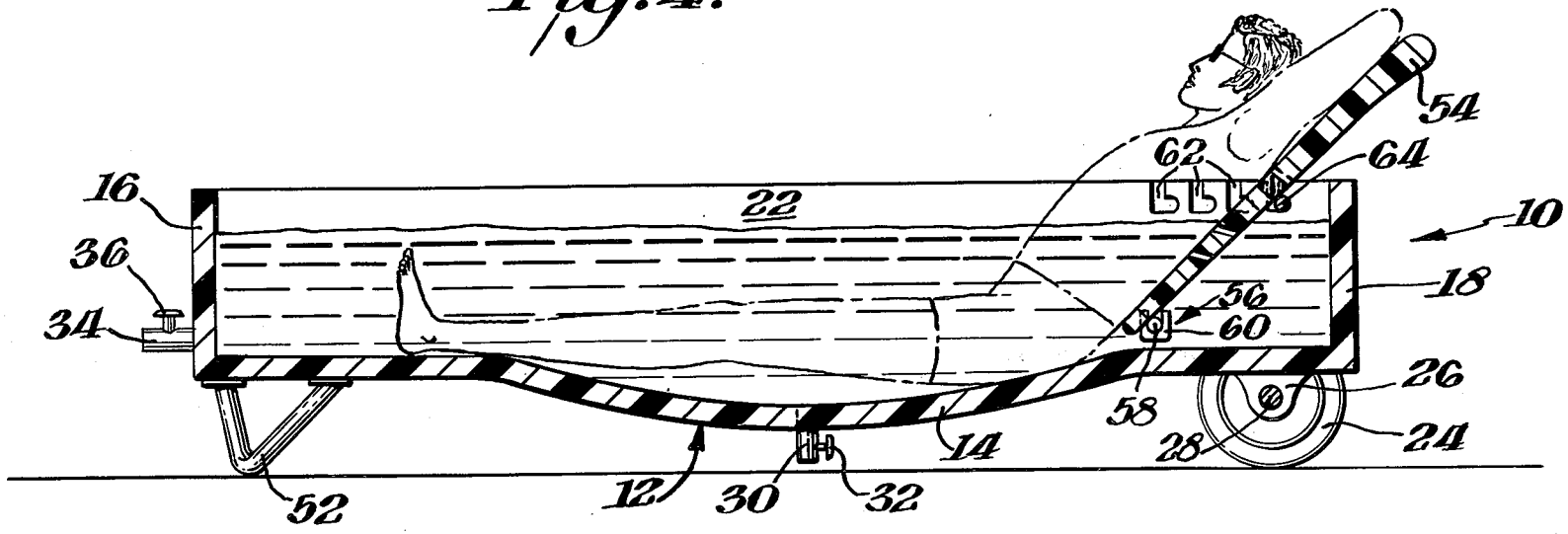
Fig. 4.
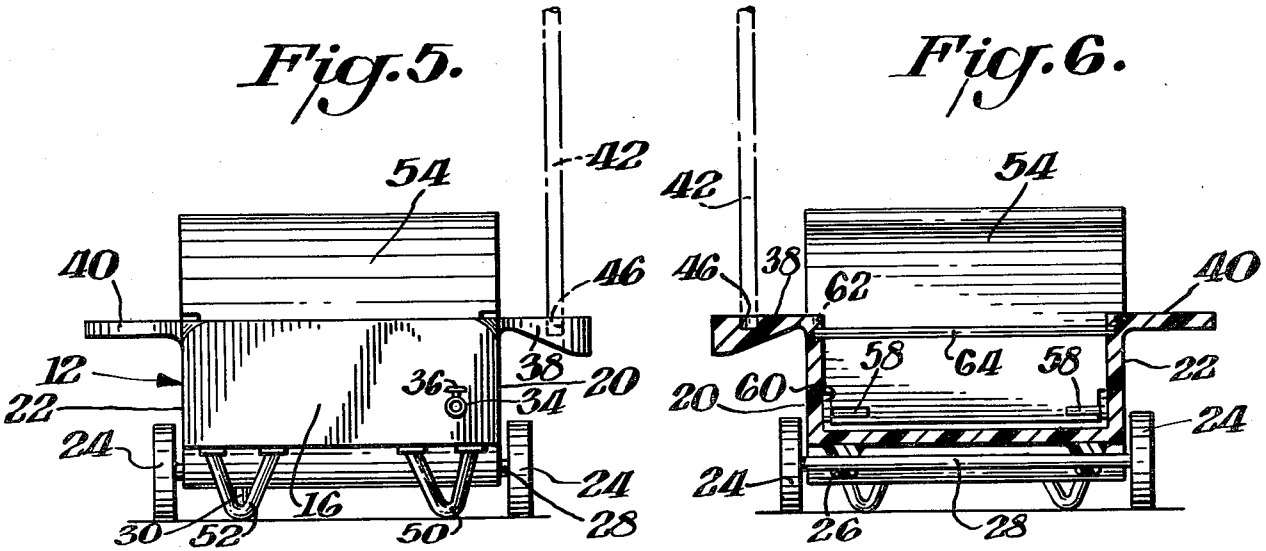
Fig. 6.
Fig. 5.

WATER LOUNGE

BACKGROUND OF THE INVENTION

The present invention relates to a water lounge, and more particularly to a portable water filled device for personal relaxation in the outdoors.

With the advent of significantly more leisure time, numerous recreational devices have been proposed for aiding man in his leisure hours. Swimming pools, both above and below ground, have met with considerable sales appeal, and the number of people utilizing such pools has drastically increased over the years. The cooling comfort of water in the summertime has played a major role in the commercial success of recreational devices that utilize water. Swimming pools are not only cumbersome and expensive but require open space where they are located. The ever increasing problem of accidents around such devices is also of concern. While the public has long sought a more convenient and less expensive device for cooling the body in the summertime, no such devices have been introduced. A device much smaller than the traditional swimming pool having the same general beneficial characteristics without the detrimental ones has long been sought.

Obviously, bathtubs offer some relief from the summer weather but these devices lack the portability and adaptability for outside use. For example, Miyakawa Pat. No. 2,566,495, granted Sept. 4, 1951, suggests a bathtub form with body rests while Petersen Pat. No. 3,496,579, granted Feb. 24, 1970, discloses a particular bathtub construction having a foot well together with body conforming portions.

SUMMARY OF THE INVENTION

Accordingly, it is an object of the present invention to provide an inexpensive and relatively simple water lounging device for outside use.

Another object of the present invention is to provide a water lounge for outside use in cooling the body in the summertime.

In accordance with the present invention a water lounge comprises a generally rectangular shaped impervious body portion including a bottom wall with front, back and side walls extending upwardly therefrom adapted to hold water. Each of a pair of spaced apart wheels is rotatably secured to the body portion near the back wall thereof, and an adjustable backrest is within the body portion also near the back wall thereof. A drain is provided in the bottom wall of the body portion, and at least one prop extends downwardly from the body portion near the front wall thereof for maintaining the body portion generally level.

Preferably, the water lounge is in combination with an umbrella releasably and adjustably secured to the body portion arranged in shading relationship thereto. Moreover, one or both of the side walls may include a generally horizontally disposed counter portion that extends outwardly at the upper portion of the side wall.

A water inlet connection is located in the lower half of the front wall of the body portion at one side thereof so that water under pressure may be introduced into the body portion in a swirling or whirlpool-like pattern. Preferably, the backrest includes a hinge connection between the body portion and the lower end of the backrest, and retaining structure spaced above the hinge connection maintains the backrest at a variety of inclinations. Also, the bottom wall of the body portion is contoured to accommodate the human body in seated position, and a pair of spaced apart props extends downwardly from the body portion near the front wall thereof, one prop in each corner of the body portion.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein similar reference characters refer to similar parts and in which:

FIG. 4 is a cross-sectional view taken along line 4—4 of FIG. 2;

FIG. 5 is a front elevational view of the water lounge shown in FIGS. 1–4; and FIG. 6 is a cross-sectional view taken along line 6–6 of FIG. 2.

DETAILED DESCRIPTION OF THE INVENTION

Figure 1:
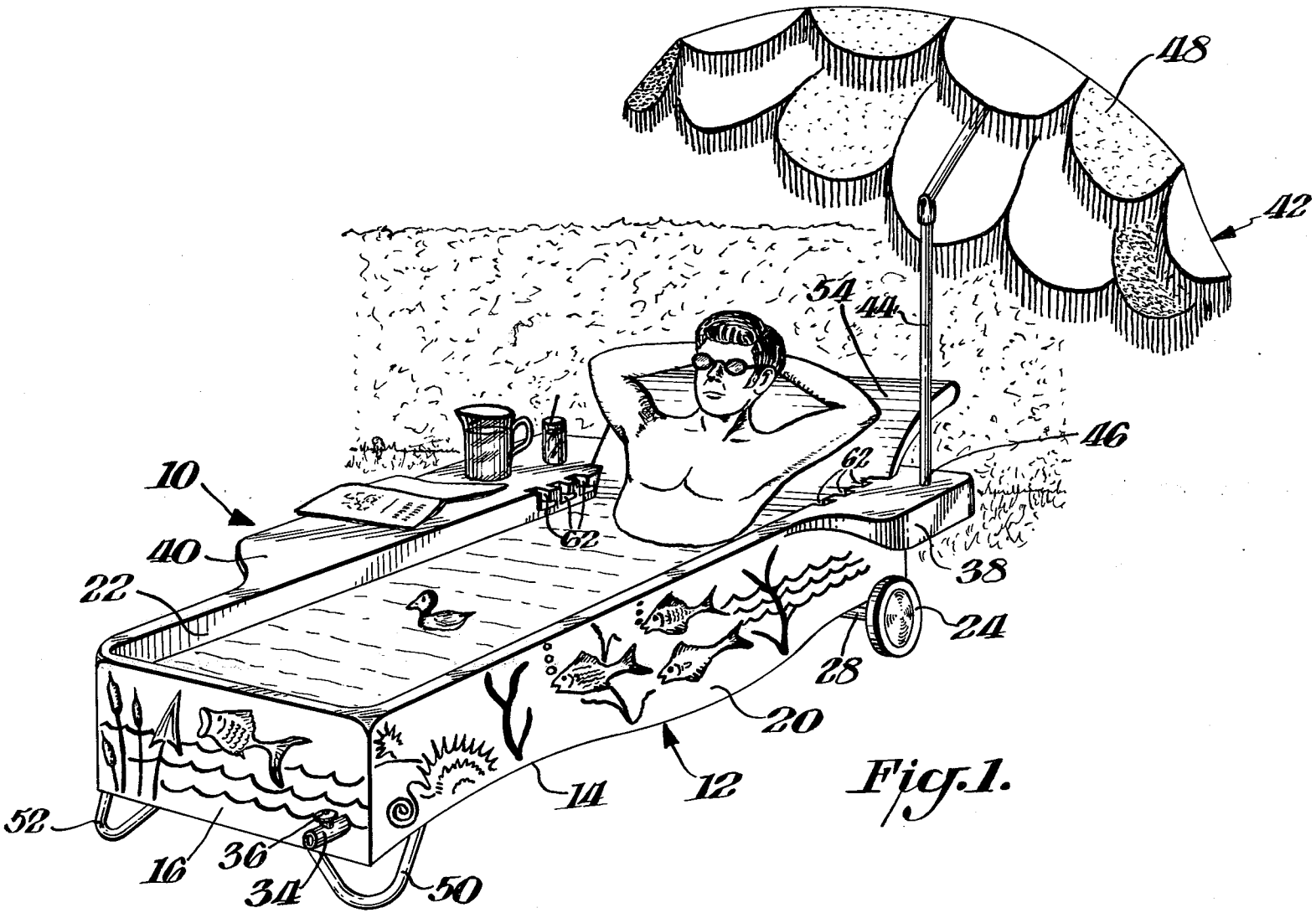
FIG. 1 is a perspective view of a water lounge according to the present invention.
Figure 2:
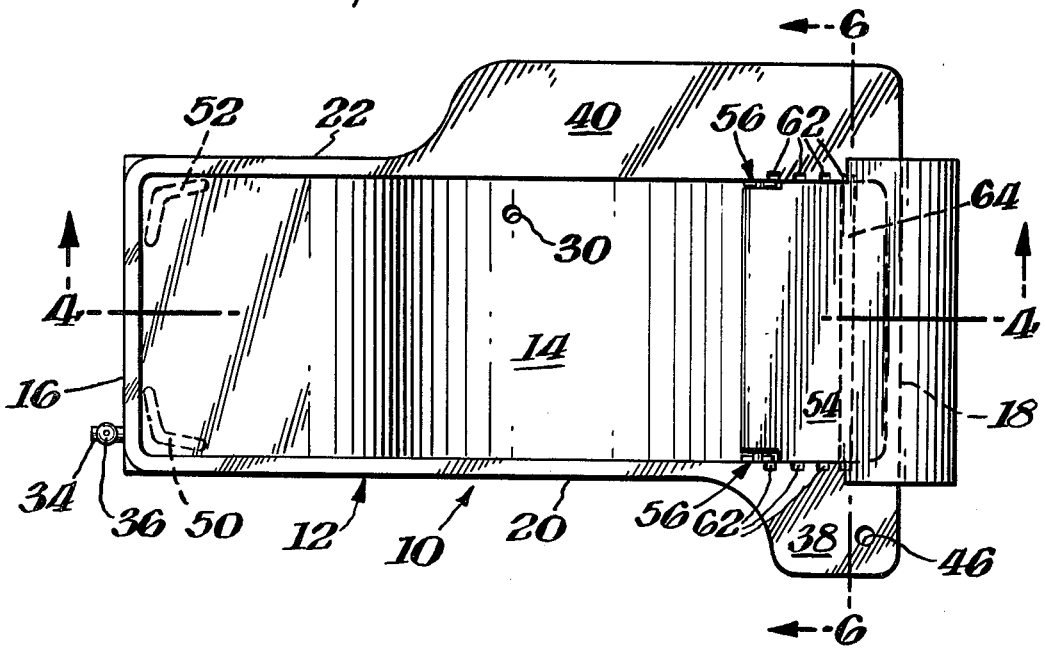
FIG. 2 is a top plan view of the water lounge shown in FIG. 1.
Figure 3:
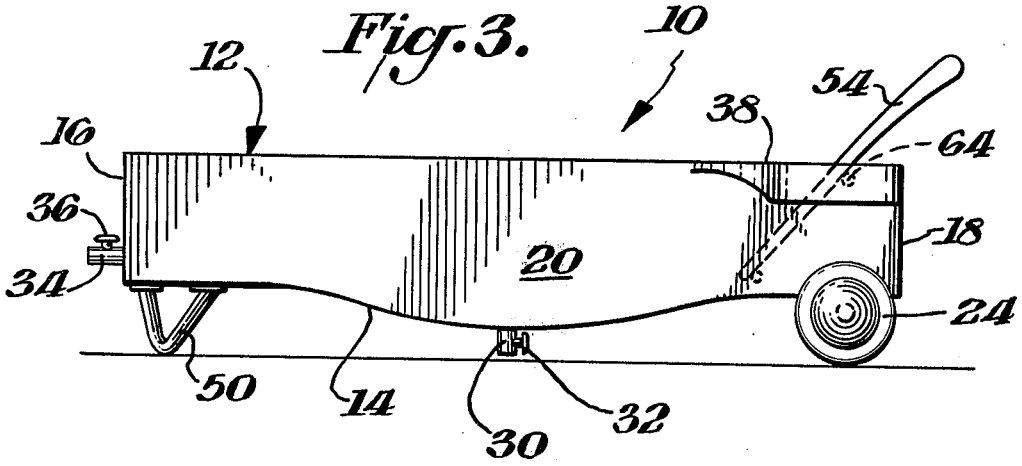
FIG. 3 is a right side elevational view of the water lounge shown in FIGS. 1 and 2.

Referring in more particularity to the drawings, FIG. 1 illustrates a water lounge 10 comprising a generally rectangular shaped impervious body portion 12. The body portion may be fabricated from durable thermoplastic material or fiberglass, for example. Also, it is preferred that the body portion be of single piece construction although the various components thereof may be individually fabricated for assembly at a later stage. Well known conventional molding and forming techniques may be utilized in the fabrication of the body portion. Specifically, the body portion 12 includes a bottom wall 14 with a front wall 16 and a back wall 18 extending upwardly therefrom. The bottom wall of the body portion is contoured to accommodate the human body in a seated position, as shown best in FIGS. 3 and 4. Side walls 20, 22 also extend upwardly from the bottom wall 14 and these side walls are integrally joined with the front and back walls to form an enclosure adapted to hold water.

Each of a pair of spaced apart wheels 24 is rotatably secured to the body portion 12 near the back wall 18. Specifically, the bottom wall 14 of the body portion includes a pair of downwardly extending tabs 26. Each tab includes an opening therein for accommodating an axle 28 to which the wheels 24 are secured.

A drain 30 is located in the bottom wall 14 of the body portion 12 for draining the water from the inside of the body portion. Preferably, the drain also includes an adjustable valve 32 for regulating the flow of water during the draining process. Also, a water inlet connection 34 is located in the lower half of the front wall 16 of the body portion 12 at one side thereof. The terminal portion of the water inlet 34 may be threaded to accommodate the female connection of a standard garden hose. The water inlet 34 also includes a valve 36 for regulating the flow of water entering into the body portion of the water lounge. In use, the valve 36 may be turned off after the filling operation or regulated so that water enters the body portion at about the same rate it is regulated to drain therefrom. Moreover, the location of the water inlet is such that as the water enters the body portion a turbulent swirling water pattern is created.

Each of the side walls 20, 22 includes a generally horizontally disposed counter portion 38, 40 which extends outwardly from its associated side wall at the upper portion thereof. These counters serve as resting places for objects utilized by the person using the water lounge 10, as best illustrated in FIG. 1.

The water lounge 10 is preferably used in combination with an umbrella 42 releasably and adjustably secured to the body portion 12 and arranged in shading relationship thereto. Specifically, the umbrella 42 includes a shaft 44 which fits within a suitable opening 46 in the counter 38. As is well known, the umbrella shaft 44 is constructed so that the canopy 48 may be manipulated into a position where it shades the sun from the water within the body portion 12. This expedient prevents the water from rapidly rising in temperature which makes the water lounge more refreshing. Also, by shading the water from the sun less frequent water changes are needed.

The front end of the water lounge 10 includes a pair of spaced apart props 50, 52 secured to the bottom wall 14 of the body portion and extending downwardly therefrom. One prop is located in each front corner of the body portion, and together these props maintain the body portion generally level.

An adjustable backrest 54 is within the body portion 12 near the back wall 18. The backrest includes a hinge connection 56 between each side of the lower end thereof and the body portion. Each hinge connection 56 includes a stub shaft 58 anchored to the backrest and extending outwardly therefrom. Each stub shaft 58 rests within a U-shaped bracket 60 secured to the interior surface of the side walls 20, 22. As shown best in FIG. 4 the hinge connection is such that the backrest may be easily removed by simply urging it in an upward direction. Also, the hinge connection enables the backrest to be manipulated into a variety of inclines. Retaining structure located above the hinge connection 56 functions to maintain the backrest at the desired inclination. The retaining structure includes a series of spaced apart cutouts 62 in the side walls 20, 22 of the body portion. The cutouts 62 are L-shaped as shown best in FIG. 4. Also, the retaining structure includes a bar 64 that fits within the cutouts 62. The retaining bar 64 is simply positioned within an appropriate pair of opposed cutouts 62 and the backrest 54 rests against the bar to maintain the backrest at the desired position. When a different backrest position is desired, the backrest is simply moved forward about the hinge connection 56 and the bar 64 repositioned.

In use the water lounge 10 of the present invention may be manipulated into a desired position out of doors by simply grasping the props 50, 52 which also function as handles. The lounge may then be wheeled to the desired location. Next, the body portion 12 is filled with water either through the water inlet 34 or by simply positioning the discharge end of a hose inside the body portion. The backrest may then be manipulated to the desired inclination and the umbrella adjusted. A water line may be connected to the inlet 34 for continuous or periodic replenishment of the lounge with fresh water. Also, it is possible to connect a hose to a drain if discharge of the lounge is desired at a location remote from the position of the lounge out of doors.

What is claimed is:

1. A water lounge comprising a generally rectangular shaped impervious body portion including a bottom wall with front, back and side walls extending upwardly therefrom adapted to hold water, a pair of spaced apart wheels rotatably secured to the body portion near the back wall thereof, an adjustable backrest within the body portion also near the back wall thereof, a drain in the bottom wall of the body portion, and at least one prop externally thereof and extending downwardly from the body portion near the front wall thereof for maintaining the body portion generally level.

2. A water lounge as in claim 1 in combination with an umbrella releasably and adjustably secured to the body portion and arranged in shading relationship thereto.

3. A water lounge as in claim 1 wherein at least one of the side walls includes a generally horizontally disposed counter portion extending outwardly therefrom at the upper portion of the side wall.

4. A water lounge as in claim 3 wherein each side wall includes a counter portion.

5. A water lounge as in claim 4 in combination with an umbrella releasably and adjustably secured to the body portion and arranged in shading relationship thereto.

6. A water lounge as in claim 1 including a water inlet connection in the lower half of the front wall of the body portion at one side thereof whereby water under pressure may be introduced into the body portion in a swirling pattern.

7. A water lounge as in claim 6 in combination with an umbrella releasably and adjustably secured to the body portion and arranged in shading relationship thereto.

8. A water lounge as in claim 1 wherein the backrest includes a hinge connection between the body portion and the lower end of the backrest, and retaining means spaced above the hinge connection for maintaining the backrest at a variety of inclinations.

9. A water lounge as in claim 1 wherein the bottom wall of the body portion is contoured to accommodate the human body in seated position.

10. A water lounge as in claim 1 wherein a pair of spaced apart props extends downwardly from the body portion near the front wall thereof, one prop in each front corner of the body portion.

* * * * *